US010491991B2

(12) United States Patent
Yoo et al.

(10) Patent No.: US 10,491,991 B2
(45) **Date of Patent: *Nov. 26, 2019**

(54) MICROPHONE AND MANUFACTURING METHOD THEREOF

(71) Applicants: Hyundai Motor Company, Seoul (KR); Kia Motors Corporation, Seoul (KR)

(72) Inventors: Ilseon Yoo, Gyeonggi-do (KR); Hyunsoo Kim, Seoul (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 15/989,693

(22) Filed: May 25, 2018

(65) Prior Publication Data

US 2018/0279040 A1 Sep. 27, 2018

Related U.S. Application Data

(62) Division of application No. 15/274,419, filed on Sep. 23, 2016, now abandoned.

(30) Foreign Application Priority Data

Sep. 25, 2015 (KR) ..... 10-2015-0137074

(51) Int. Cl.
*H04R 1/32* (2006.01)
*H04R 1/04* (2006.01)
(Continued)

(52) U.S. Cl.
CPC ..... *H04R 1/326* (2013.01); *H04R 1/04* (2013.01); *H04R 19/005* (2013.01);
(Continued)

(58) Field of Classification Search
None
See application file for complete search history.

(56) References Cited

U.S. PATENT DOCUMENTS 7,904,123 B2 * 3/2011 Makihata ..... B81B 7/0077 381/361
8,126,166 B2 * 2/2012 Song ..... H04R 19/04 381/174
(Continued)

FOREIGN PATENT DOCUMENTS

JP 2007-124452 A 5/2007
KR 10-0638512 B1 10/2006
(Continued)

OTHER PUBLICATIONS

Ilseon and Kim, Hyunsoo, "A development of the directional MEMS microphone for automotive applications," FISITA 2016, Sep. 2016.
(Continued)

*Primary Examiner* — Michelle Mandala
*Assistant Examiner* — Jordan M Klein
(74) *Attorney, Agent, or Firm* — Mintz Levin Cohn Ferris Glovsky and Popeo, P.C.; Peter F. Corless

(57) ABSTRACT

A microphone and a method for manufacturing the same are disclosed. The microphone includes: a main substrate in which a first sound hole is formed; a sound sensing module formed in the main substrate corresponding to the first sound hole; a semiconductor chip electrically connected with the sound sensing module and formed on the main substrate; a cover mounted to the main substrate, and in which a second sound hole is formed; and a sound delay filter mounted corresponding to the second sound hole, and in which a plurality of filter holes are formed.

8 Claims, 11 Drawing Sheets

(51) Int. Cl.
*H04R 19/00* (2006.01)
*H04R 31/00* (2006.01)
*H04R 1/34* (2006.01)

(52) U.S. Cl.
CPC ..... *H04R 31/006* (2013.01); *H04R 1/347* (2013.01); *H04R 2201/003* (2013.01); *H04R 2410/07* (2013.01)

(56) References Cited

U.S. PATENT DOCUMENTS 8,526,656 B2 * 9/2013 Tanaka ..... H04R 1/38 381/163
8,989,424 B2 * 3/2015 Sibbald ..... H04R 1/10 381/371
9,736,605 B2 * 8/2017 Yoo ..... H04R 19/005
2005/0207605 A1 * 9/2005 Dehe ..... H04R 19/04 381/369
2016/0150324 A1 * 5/2016 Yoo ..... H04R 19/04 381/356
2016/0150326 A1 * 5/2016 Yoo ..... H04R 31/00 381/174

FOREIGN PATENT DOCUMENTS

KR 10-0722687 B1 5/2007
KR 10-0740462 B1 7/2007
KR 2007-0115035 A 12/2007
KR 10-1601120 B1 3/2016
KR 10-1601219 B1 3/2016
KR 10-1610129 B1 4/2016
KR 10-1610156 B1 4/2016
KR 10-1619253 B1 5/2016
KR 2016-0063145 A 6/2016
WO WO-2007043729 A1 * 4/2007 ..... H04R 1/38

OTHER PUBLICATIONS

Yoo, Ilseon and Kim, Hyunsoo, "A Development of the Directional MEMS microphone for automotive applications," English translation, 3 pages.

* cited by examiner

| Type ( # ) | Hole split | | | Direction difference (dB) |
|---|---|---|---|---|
| | r (um) | ℓ (um) | Hole ratio(%) | |
| 1 | 25 | 250 | 3.1 | 0 |
| 2 | 50 | 250 | 12.4 | 6.5 |
| 3 | 75 | 250 | 27.8 | 15 |
| 4 | 100 | 250 | 49.5 | 5.2 |

[ Direction difference depending on hole radius ]

[ Polar pattern depending on hole radius ]

MICROPHONE AND MANUFACTURING METHOD THEREOF

CROSS-REFERENCE TO RELATED APPLICATION

This application is a Divisional Application of U.S. patent application Ser. No. 15/274,419 filed on Sep. 23, 2016 which claims priority to and the benefit of Korean Patent Application No. 10-2015-0137074 filed in the Korean Intellectual Property Office on Sep. 25, 2015, the entire contents of which are incorporated herein by reference.

BACKGROUND OF THE DISCLOSURE (a) Field of the Disclosure

The present disclosure relates generally to a microphone and a manufacturing method thereof, and more particularly, to a microphone that realizes a direction characteristic by applying a sound delay filter, and a manufacturing method thereof.

(b) Description of the Related Art

In general, a microphone is known as a device that converts sound to an electric signal. The microphone can be applied to mobile communication devices such as a smart phone or other various communication devices such as an earphone, a hearing aid, and the like. Such implementations require a microphone with good sound performance, reliability, and operability.

Microphones are classified into a non-directional (omni-directional) and a directional. The directional microphone is a microphone where sensitivity is changed according to a direction of an incident sound wave, and is classified into single directional microphones and bi-directional microphones. For example, the directional microphone is often used for recording in a small room or for picking up only desired sound in a room with reverberation.

A micro-electro-mechanical system (MEMS)-based capacitive microphone (hereinafter referred as a MEMS microphone) has excellent sound performance, reliability, and operability compared to a conventional electret condenser microphone. When such microphone is employed in a vehicle, the microphone must be robust to variation in the noise environment because the vehicle environment is one where a sound source is distant and a noise is variably generated. However, in order to realize the MEMS-based directional microphone, two or more MEMS microphones are required, thereby increasing cost.

The above information disclosed in this Background section is only for enhancement of understanding of the background of the disclosure, and therefore it may contain information that does not form the related art that is already known in this country to a person of ordinary skill in the art.

SUMMARY OF THE DISCLOSURE

The present disclosure has been made in an effort to provide a microphone that can realize a directional characteristic by applying a sound delay filter where a plurality of holes are regularly arranged, and a method for manufacturing the same.

A microphone according to embodiments of the present disclosure includes: a main substrate in which a first sound hole is formed; a sound sensing module formed in the main substrate corresponding to the first sound hole; a semiconductor chip electrically connected with the sound sensing module and formed on the main substrate; a cover mounted to the main substrate, and in which a second sound hole is formed; and a sound delay filter mounted corresponding to the second sound hole, and in which a plurality of filter holes are formed.

The plurality of filter holes may be arranged in a matrix format.

A radius of a filter hole of the plurality of filter holes may be between approximately 70 μm and approximately 80 μm.

A distance between centers of neighboring filter holes of the plurality of filter holes may be between approximately 200 μm and approximately 300 μm.

A hole ratio, which is a ratio of an area of the plurality of filter holes to an area of the second sound hole, may be between approximately 25% and approximately 30%.

The hole ratio may be calculated based on a number of the plurality of filter holes, an area of each filter hole, and the area of the second sound hole.

The sound delay filter may be fixed to a receiving groove formed along a circumference of the second sound hole.

The receiving groove may be formed in an exterior surface of the cover.

The receiving groove may be formed in an interior surface of the cover.

The sound delay filter may be adhered to the receiving groove via an adhesive coated to a bottom surface of the receiving groove.

The sound sensing module may have a non-directional characteristic and the microphone has a directional characteristic.

Furthermore, in accordance with embodiments of the present disclosure, a method for manufacturing a microphone includes: forming a sound sensing module at a location corresponding to a first sound hole formed in a main substrate; forming a semiconductor chip that is electrically connected with the sound sensing module on the main substrate; mounting a cover in which a second sound hole is formed to the main substrate; and mounting a sound delay filter in which a plurality of filter holes are formed at a location corresponding to the second sound hole.

The method may further include manufacturing the plurality of filter holes in the sound delay filter through: depositing an oxide layer on a filter substrate; depositing a metal layer on the oxide layer; patterning the metal layer; etching the oxide layer and the filter substrate using the metal layer as a mask; and removing the oxide layer and the metal layer.

A radius of a filter hole of the plurality of filter holes may be between approximately 70 μm and approximately 80 μm.

A distance between centers of neighboring filter holes of the plurality of filter holes may be between approximately 200 μm and approximately 300 μm.

A hole ratio, which is a ratio of an area of the plurality of filter holes to an area of the second sound hole, may be between approximately 25% and approximately 30%.

The mounting of the sound delay filter may include fixing the sound delay filter to a receiving groove formed in a circumference of the second sound hole.

The receiving groove may be formed in an exterior surface of the cover.

The receiving groove may be formed in an interior surface of the cover.

The mounting of the sound delay filter may include adhering the sound delay filter to a receiving groove formed in a circumference of the second sound hole via an adhesive coated to a bottom surface of the receiving groove.

According to the embodiments of the present disclosure, a directional characteristic of the microphone can be realized using the sound delay filter where the plurality of filter holes are formed. In addition, the porous sound delay filter can be manufactured through a batch process so that a package process error can be reduced, thereby providing advantageous effects in yield and manufacturing cost.

Effects that can be obtained or expected from exemplary embodiments of the present disclosure are directly or suggestively described in the following detailed description. That is, various effects expected from embodiments of the present disclosure will be described in the following detailed description.

| <Description of symbols> | |
|---|---|
| 1: microphone | 10: main substrate |
| 11: first sound hole | 13: electrode pad |
| 20: cover | 21: second sound hole |
| 23: receiving groove | 25: adhesive |
| 30: sound sensing module | 31: module substrate |
| 33: vibration membrane | 35: support layer |
| 37: fixed membrane | 40: semiconductor chip |
| 50: sound delay filter | 51: filter substrate |
| 53: oxide layer | 55: metal layer |
| H: filter hole | S: receiving space |
| P1: first pad | P2: second pad |

DETAILED DESCRIPTION OF THE EMBODIMENTS

Hereinafter, embodiments of the present disclosure will be described with reference to the accompanying drawings. However, the present disclosure is not limited to only the embodiments demonstrated in the following drawings and description.

Detailed descriptions of well-known functions and structures incorporated herein may be omitted to avoid obscuring the subject matter of the present disclosure. The terms used herein are defined according to the functions of the present disclosure, and may vary depending on a user's or an operator's intension and usage. Therefore, the terms used herein should be understood based on the descriptions made herein. Further, in order to effectively describe technical characteristics of the present disclosure, the following embodiments may appropriately change, integrate, or separate terms to be clearly understood by a person of ordinary skill in the art, and thus, the present disclosure is not limited thereto.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g., fuels derived from resources other than petroleum). As referred to herein, a hybrid vehicle is a vehicle that has two or more sources of power, for example both gasoline-powered and electric-powered vehicles.

Figure 1:
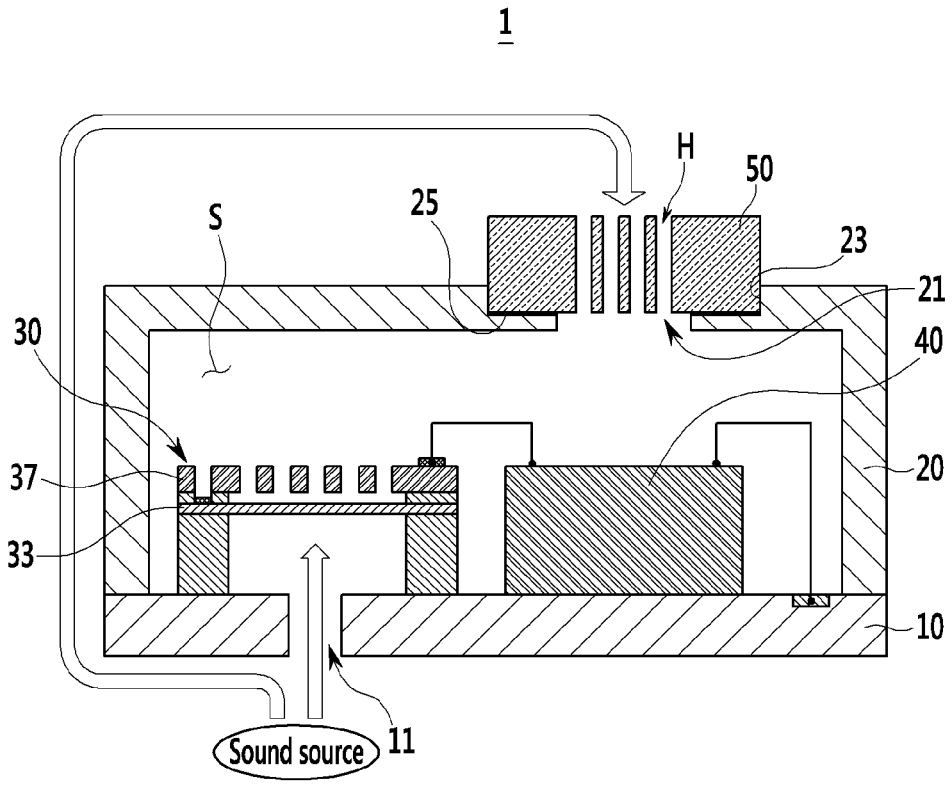
FIG. 1 is a schematic diagram of a microphone according to embodiments of the present disclosure.
Figure 2:
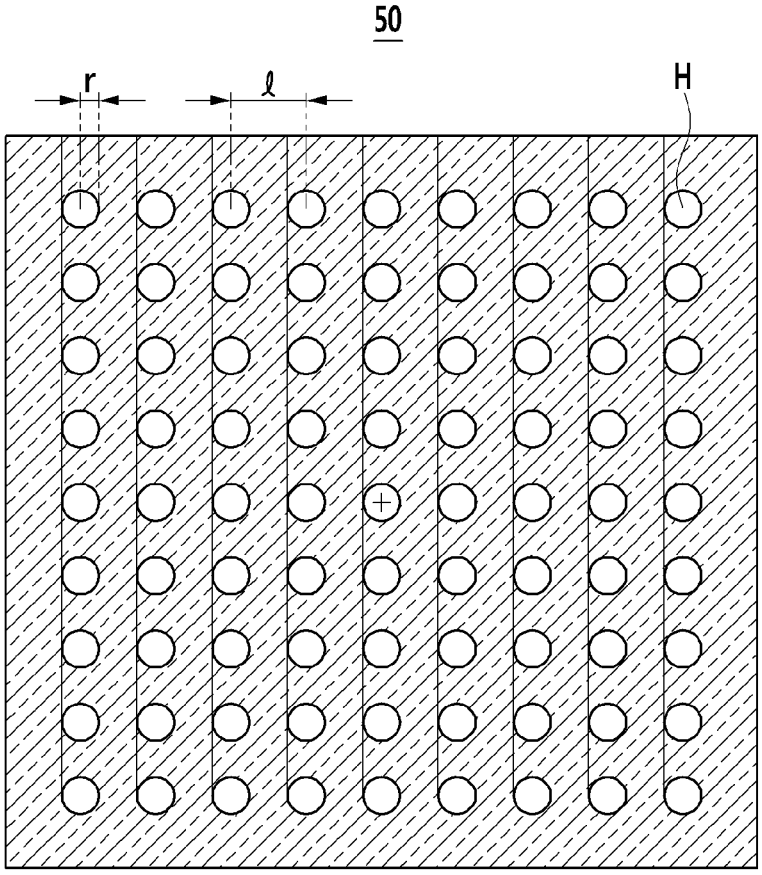
FIG. 2 shows a sound delay filter of the microphone according to embodiments of the present disclosure.
Figure 3:
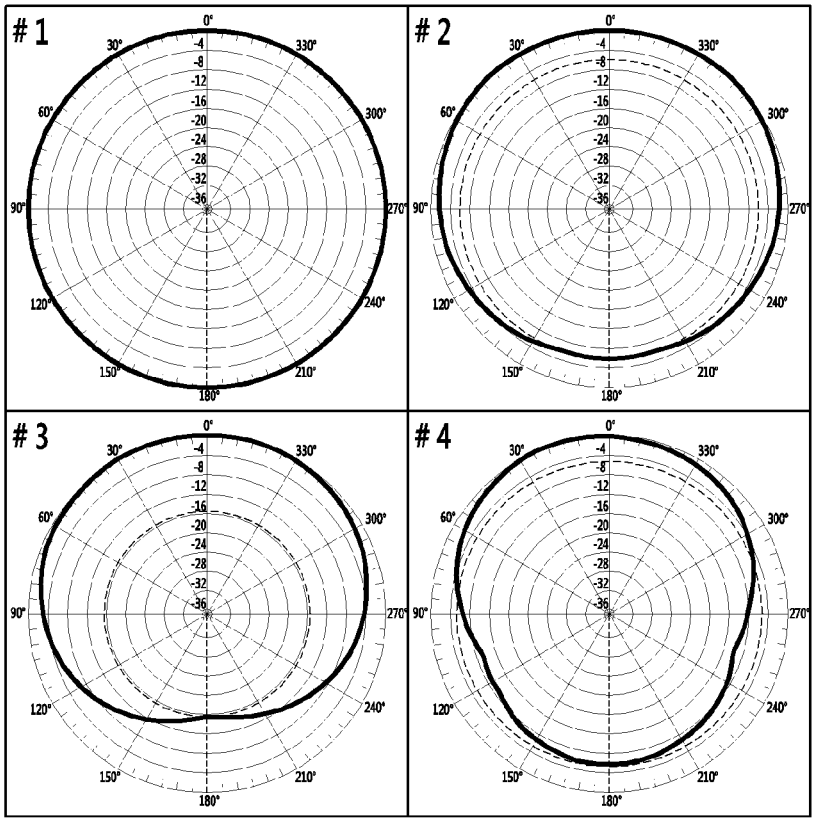
FIG. 3 is an experiment graph illustrating a direction characteristic of the microphone according to embodiments of the present disclosure.

Referring now to the disclosed embodiments, FIG. 1 is a schematic diagram of a microphone according to embodiments of the present disclosure, FIG. 2 shows a sound delay filter of the microphone according to embodiments of the present disclosure, and FIG. 3 is an experiment graph illustrating a direction characteristic of the microphone according to embodiments of the present disclosure.

As shown in FIG. 1, a microphone 1 according to embodiments of the present disclosure includes a main substrate 10, a cover 20, a sound sensing module 30, a semiconductor chip 40, and a sound delay filter 50.

The main substrate 10 may be formed of a printed circuit board (PCB). A first sound hole 11 is formed in the main substrate 10. The first sound hole 11 is a path for receiving external sound.

The cover 20 is mounted on the main substrate 10 while forming a predetermined receiving space S. The cover 20 may be made of a metal material (e.g., a metal cap). A second sound hole 21 is formed at one upper side of the cover 20. Like the first sound hole 21, the second sound hole 21 is a path through which external sound is introduced.

The sound sensing module 30 is formed on the main substrate 10 and is thus disposed in the receiving space S. The sound sensing module 30 is disposed at a location corresponding to the first sound hole 11 to receive sound input from the first sound hole 11 and the second sound hole 21. The sound sensing module 30 includes a vibration membrane 33 and a fixed membrane 37. When the external sound is applied to the vibration membrane 33, a gap between the vibration membrane 33 and the fixed membrane 37 is changed, and accordingly, capacitance between the vibration membrane 33 and the fixed membrane 37 is changed. The sound sensing module 30 outputs a varying capacitance signal to the semiconductor chip 40. Such a sound sensing module 30 may be, for example, a micro-electro-mechanical system (MEMS)-based capacitive type of MEMS element, and may have a non-directional characteristic.

The semiconductor chip 40 is electrically connected with the sound sensing module 30, and is disposed in the receiving space S. The semiconductor chip 40 according to embodiments of the present disclosure is exemplarily disposed in the receiving space S, but the present disclosure is not limited thereto, and the semiconductor chip 40 can be disposed in any location as long as it can be electrically connected with the sound sensing module 30. For example, the semiconductor chip 40 may be electrically connected with the sound sensing module 30 at the outside of the receiving space S of the cover 20. The semiconductor chip 40 receives the capacitance signal output from the sound sensing module 30 and transmits the received signal to the outside. The semiconductor chip 40 may be an application specific integrated circuit (ASIC).

The sound delay filter 50 is disposed above the sound sensing module 30. The sound delay filter 50 is disposed corresponding to the second sound hole 21 formed in the cover 20 such that sound introduced into the second sound hole 21 passes it. The sound delay filter 50 is fixed to a receiving groove 23 formed along the circumference of the second sound hole 21. The receiving groove 23 may be formed in an exterior surface of the cover 20, and the sound delay filter 50 may be adhered to the receiving groove 23 through an adhesive 25 coated to the bottom surface of the receiving groove 23. The adhesive 25 may be an epoxy.

As shown in FIG. 2, a plurality of filter holes H may be formed in the sound delay filter 50, and the sound delay filter 50 may be made of a silicon material. The plurality of filter holes may be arranged in a matrix format. Each filter hole may have a radius r in a range between 70 μm and 80 μm. A distance I between centers of neighboring filter holes H may have a range between 200 μm and 300 μm.

A hole ratio HR, which is a ratio of the area of the plurality of filter holes H with respect to the area of the second sound hole 21 may be between 25% and 30%. The hole ratio HR may be calculated based on the number of the plurality of filter holes H, the area of each filter hole H, and the area of the second sound hole 21 using the following Equation 1.

$$HR=((A1\times A2)/B)\times 100 \quad \text{[Equation 1]}$$

Here, A1 denotes the number of the plurality of filter holes H, A2 denotes the area of each filter hole H, and B denotes the area of the second sound hole 21.

As shown in FIG. 3, when the radius r of the filter hole H is 75 μm, the distance I between centers of neighboring filter holes H is 250 μm, and the hole ratio HR is 27.8%, the microphone 1 has a polar pattern (#3) and a direction characteristic is 15 dB, which indicates the highest direction of the directional characteristic. It should be noted that the numbers/measurements with respect to the filter holes listed above are provided approximate values.

Figure 4:
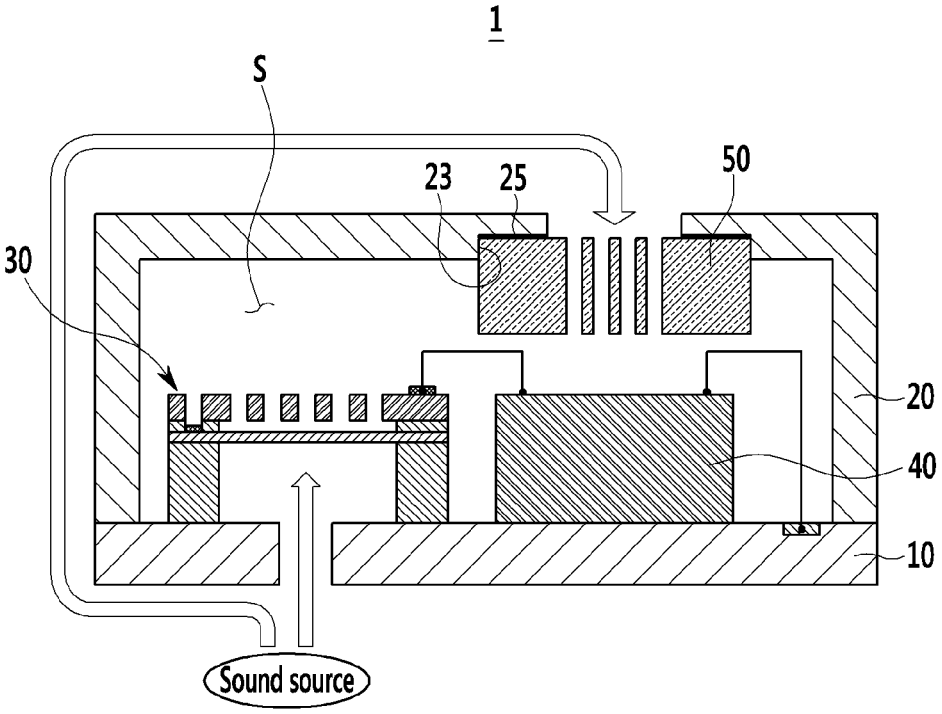
FIG. 4 is an additional schematic diagram of a microphone according to embodiments of the present disclosure.

FIG. 4 is an additional schematic diagram of a microphone according to embodiments of the present disclosure.

As shown in FIG. 4, a microphone according to another exemplary embodiment of the present disclosure is basically similar to the microphone of FIG. 1 except that a receiving groove 23 where a sound delay filter 50 is received in formed in an inner surface of a cover 20.

The sound delay filter 50 is adhered to the receiving groove by an adhesive 25 coated to the bottom surface of the receiving groove 23. Accordingly, the sound delay filter 50 is disposed in a receiving space S formed by a main substrate 10 and the cover 20.

Hereinafter, a method for manufacturing a microphone according to embodiments of the present disclosure will be described.

FIG. 5 to FIG. 11 are process cross-sectional views of a manufacturing method of a microphone according to embodiments of the present disclosure.

Figure 5:
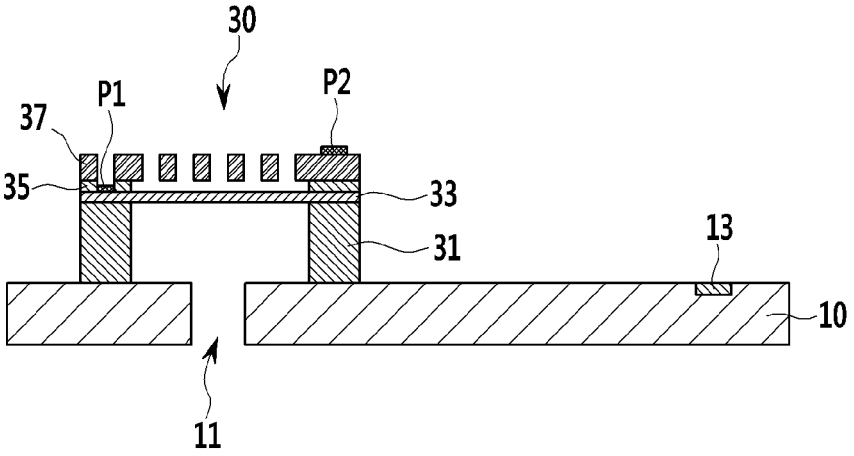
FIG. 5 to FIG. 11 are process cross-sectional views of a microphone according to embodiments of the present disclosure.

As shown in FIG. 5, a first sound hole 11 is formed in a part of a main substrate 10. The first sound hole 11 is a path for receiving sound from the outside.

An electrode pad 13 that is electrically connected with a semiconductor chip 40 is patterned in one upper side of the main substrate 10.

A sound sensing module 30 is formed at a location corresponding to the first sound hole 11 on the main substrate 10.

Hereinafter, a method for manufacturing the sound sensing module 30 will be schematically described.

A vibration membrane 33 is formed on a module substrate 31. The module substrate 31 may be made of silicon, and the vibration membrane 33 may be made of polysilicon or a conductive material.

A fixed membrane 37 is formed on the vibration membrane 33. The fixed membrane 37 may be formed of polysilicon or metal.

In this case, a support layer 35 is formed between the vibration membrane 33 and the fixed membrane 37. Such a support layer 35 is formed along the edge of the vibration membrane 33 to support the fixed membrane 37 formed thereabove, and accordingly, the vibration membrane 33 and the fixed membrane 37 are disposed at a constant distance from each other.

A first pad P1 is formed for electrical connection in the vibration membrane 33, and a second pad P2 is formed for electrical connection in the fixed membrane 37. The first pad P1 exposes the vibration membrane 33 by partially removing the fixed membrane 37 and a sacrificial layer, and then is formed on the exposed vibration membrane 33.

Figure 6:
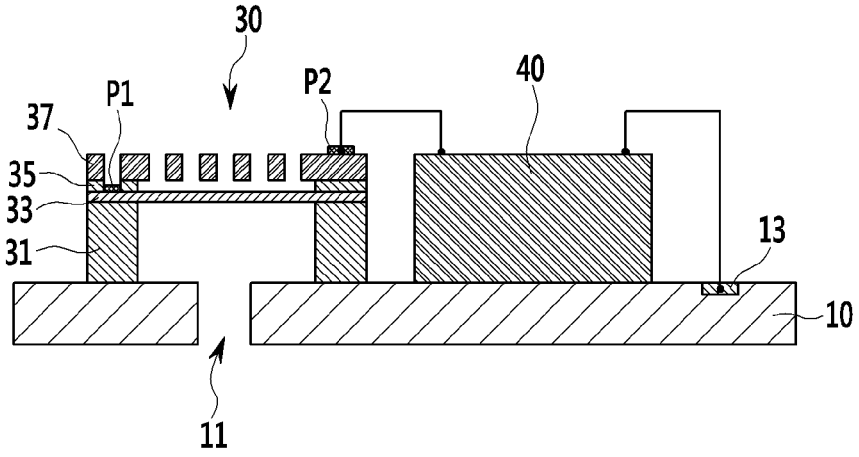

As shown in FIG. 6, the semiconductor chip 40 electrically connected with the sound sensing module 30 is formed on the main substrate 10.

The sound sensing module 30 is connected with the semiconductor chip 40 through the second pad P2, and the semiconductor chip 40 is electrically connected to the electrode pad 13 on the main substrate 10.

Figure 7:
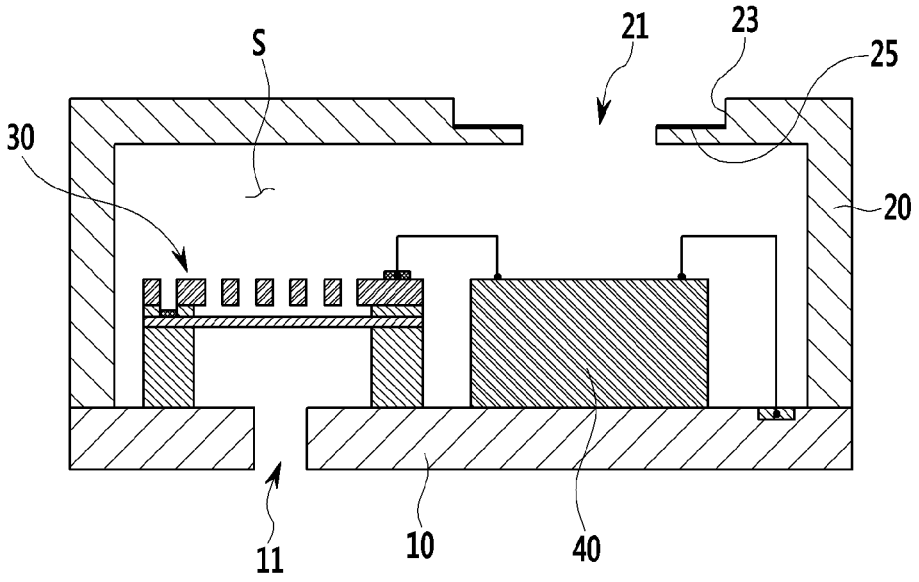

As shown in FIG. 7, the cover 20 is mounted to the main substrate 10 such that a receiving space S that receives the sound sensing module 30 and the semiconductor chip 40 is formed.

The second sound hole 21 is formed on an upper surface of the cover 20.

A receiving groove 23 is formed at the circumference of the second sound hole 21, and the adhesive 25 is coated to the bottom surface of the receiving groove 23. Such a receiving groove 23 may be formed in an exterior or interior surface of the cover 20.

Figure 8:
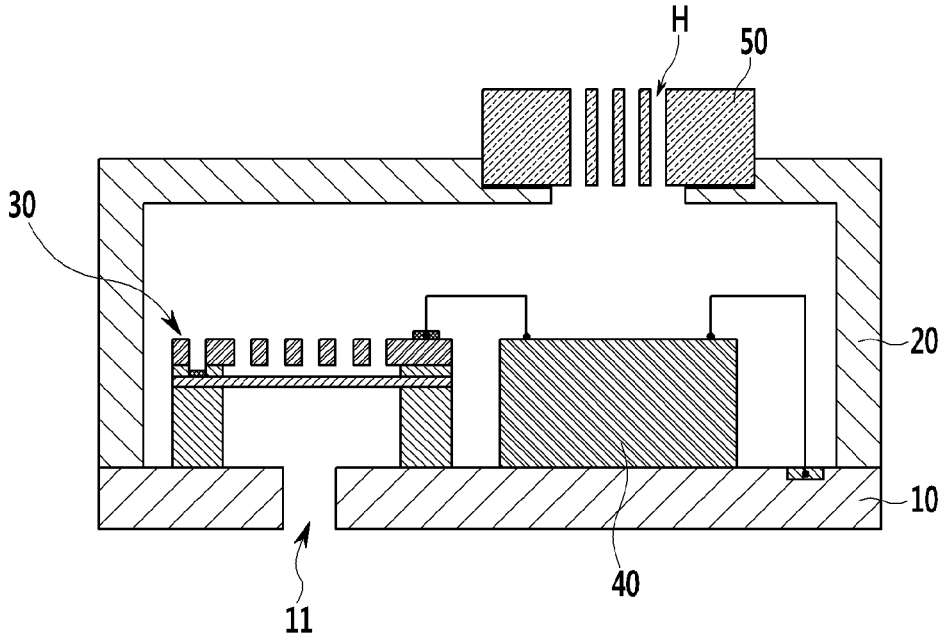

As shown in FIG. 8, the sound delay filter 50 is mounted to the receiving groove 23. That is, the sound delay filter 50 is adhered through the adhesive 25 coated to the bottom surface of the receiving groove 23.

The method for manufacturing the sound delay filter 50 is as follows.

Figure 9:
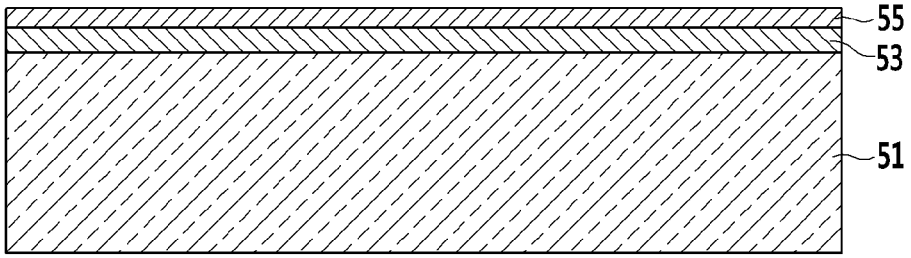

As shown in FIG. 9, an oxide layer 53 is deposited on a filter substrate 51. The oxide layer 53 may be made of silicon dioxide ($SiO_2$).

A metal layer 55 is deposited on the oxide layer 53. The metal layer 55 may be made of aluminum (Al).

Figure 10:
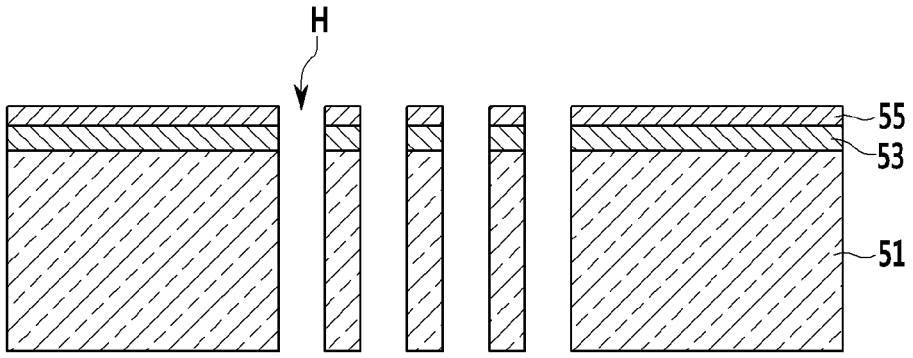

As shown in FIG. 10, after the metal layer 55 is patterned, the oxide layer 53 and the filter substrate 51 are etched using the metal layer 55 as a mask.

Figure 11:
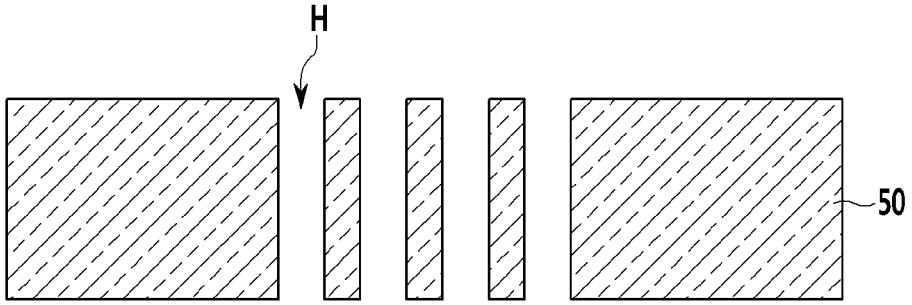

As shown in FIG. 11, a sound delay filter 50 where the oxide layer 53 and the metal layer 55 are removed and a plurality of filter holes H are formed such that a sound delay filter 50 is manufactured.

As described above, according to embodiments of the present disclosure, the microphone 1 having a directional characteristic and a high directional difference can be realized by applying the porous sound delay filter 50 so that the microphone 1 can output a highly sensitive signal. In addition, since the receiving groove 23 is provided in the microphone 1 to receive the sound delay filter 50, an alignment error can be prevented, and the sound delay filter 50 can be prevented from being detached by fixing the sound delay filter 50 using the adhesive 25. Also, the microphone 1 can be manufactured through a batch process, and when being packaged, occurrence of process errors can be reduced, thereby reducing yield and manufacturing cost.

While the contents of the present disclosure have been described in connection with what is presently considered to be practical embodiments, it is to be understood that the disclosure is not limited to the disclosed embodiments, but, on the contrary, is intended to cover various modifications and equivalent arrangements included within the spirit and scope of the appended claims.

What is claimed is:

1. A method for manufacturing a microphone, comprising:

forming a sound sensing module at a location corresponding to a first sound hole formed in a main substrate;

forming a semiconductor chip that is electrically connected with the sound sensing module on the main substrate;

mounting a cover, in which a second sound hole is formed, to the main substrate;

mounting a sound delay filter, in which a plurality of filter holes are formed, at a location corresponding to the second sound hole; and manufacturing the plurality of filter holes in the sound delay filter through:

depositing an oxide layer on a filter substrate;

depositing a metal layer on the oxide layer;

patterning the metal layer;

etching the oxide layer and the filter substrate using the metal layer as a mask; and removing the oxide layer and the metal layer.

2. The method for manufacturing the microphone of claim 1, wherein a radius of a filter hole of the plurality of filter holes is between approximately 70 μm and approximately 80 μm.

3. The method for manufacturing the microphone of claim 1, wherein a distance between centers of neighboring filter holes of the plurality of filter holes is between approximately 200 μm and approximately 300 μm.

4. The method for manufacturing the microphone of claim 1, wherein a hole ratio, which is a ratio of an area of the plurality of filter holes to an area of the second sound hole, is between approximately 25% and approximately 30%.

5. The method for manufacturing the microphone of claim 1, wherein the mounting of the sound delay filter comprises fixing the sound delay filter to a receiving groove formed in a circumference of the second sound hole.

6. The method for manufacturing the microphone of claim 5, wherein the receiving groove is formed in an exterior surface of the cover.

7. The method for manufacturing the microphone of claim 5, wherein the receiving groove is formed in an interior surface of the cover.

8. The method for manufacturing the microphone of claim 1, wherein the mounting of the sound delay filter comprises adhering the sound delay filter to a receiving groove formed in a circumference of the second sound hole via an adhesive coated to a bottom surface of the receiving groove.

* * * * *